US005104024A

United States Patent [19]

Brewer et al.

[11] Patent Number: 5,104,024

[45] Date of Patent: Apr. 14, 1992

[54] APPARATUS FOR INSTALLING FASTENERS

[75] Inventors: Jonathan L. Brewer, Dunstable; Keith Denham, Welwyn; Raymond D. Lacey, Essendon; Glenn Stride, Ickleford, all of England

[73] Assignee: Avdel Systems Limited, A British Company, Welwyn Garden City, England

[21] Appl. No.: 527,445

[22] Filed: May 23, 1990

[30] Foreign Application Priority Data

May 26, 1989 [GB] United Kingdom ..... 8912126

[51] Int. Cl.[5] ..... B21J 15/28

[52] U.S. Cl. ..... 227/2; 227/55; 227/135; 29/243.521; 901/41

[58] Field of Search ..... 227/135, 2, 3, 55, 111, 227/52, 120; 29/809, 243.521, 243.523; 72/391.6; 901/41, 6; 414/222, 223, 225

[56] References Cited

U.S. PATENT DOCUMENTS

| | | | |
|---|---|---|---|
| 3,096,522 | 4/1963 | Ajouelo | 227/109 |
| 3,557,597 | 1/1971 | Heslop et al. | 72/391 |
| 4,044,462 | 8/1977 | Anselmo | 29/809 |

*Primary Examiner*—Frank T. Yost
*Assistant Examiner*—Allan M. Schrock
*Attorney, Agent, or Firm*—Oblon, Spivak, McClelland, Maier & Neustadt

[57] ABSTRACT

For use in a robotically operated workstation, apparatus for installing fasteners, for example tubular blind rivets, comprises a pneumatically operated fastener installation tool 16. The tool 16 has a part in the form of a headed mandrel 22 which is loaded with and carries a finite supply of the fasteners, a gripping and pulling actuator 26 and a nose assembly 21 which provides an abutment 18 for supporting successive rivets while the mandrel is pulled to draw its head through and set the rivet. For reloading the tool with further fasteners, after use, the apparatus includes a nest **96*b* for detaching and receiving the mandrel 22, together with the nose assembly 21, from the actuator 26, and a similar nest 96*a* provided with another nose assembly and another mandrel fully loaded with fasteners which it presents and attaches to the actuator 26. An indexing table 110 interchanges the nests $96_a$, and $96_b$ between a station for reception and presentation of mandrels with nose assemblies, and a reloading station at which further fasteners are loaded on to a mandrel by feeding and transfer means 150. An alternative or supplementary reloading system includes a nest 90 for reception of a used mandrel and nose assembly from the tool 16, and at least one other nest 91** containing another nose assembly and a mandrel carrying a full load of fasteners for presentation to a tool actuator from which the mandrel and nose assembly have been removed.

18 Claims, 8 Drawing Sheets

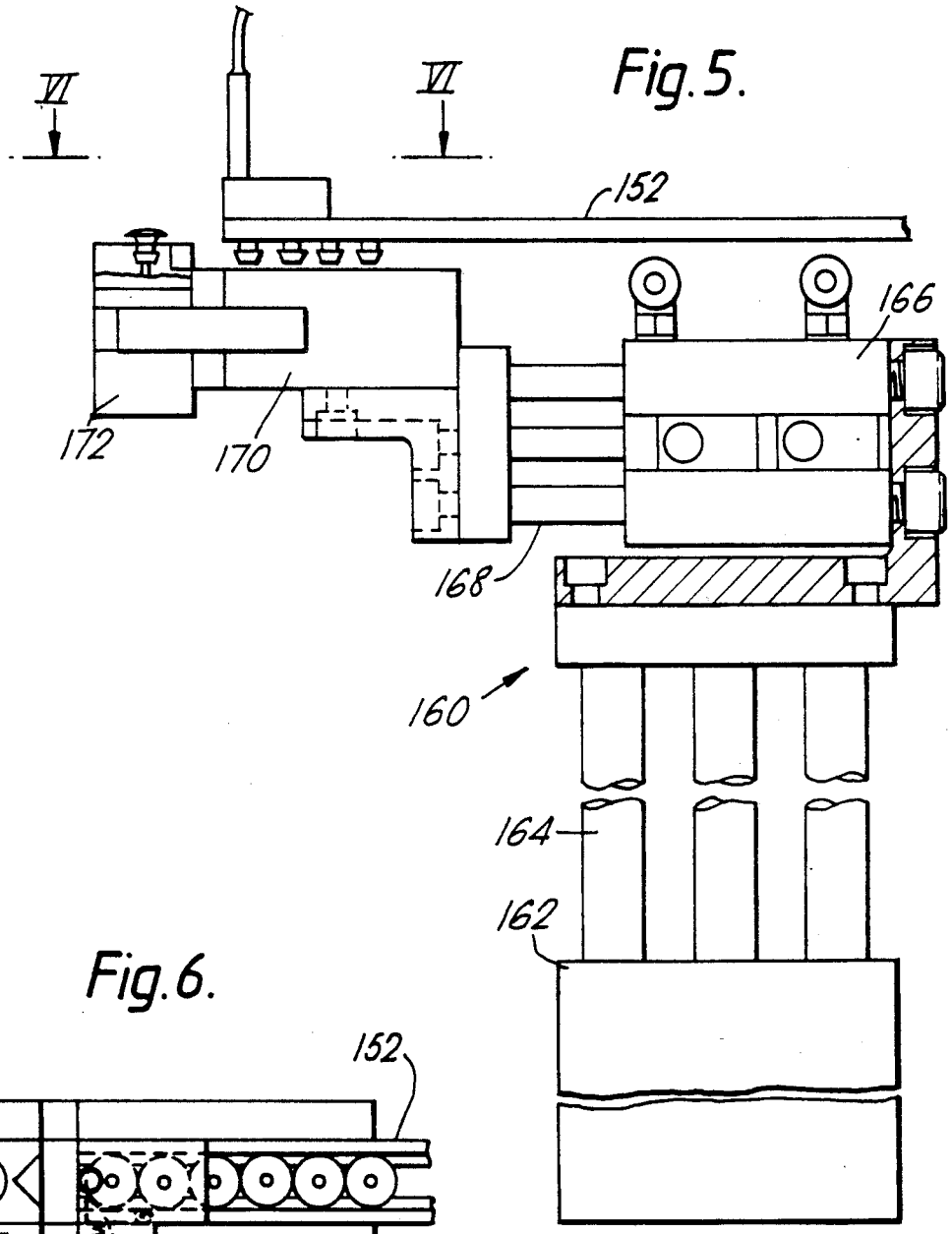
Fig. 5.
Fig. 6.
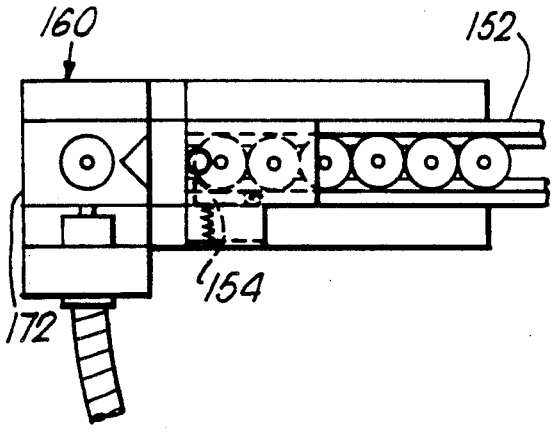

APPARATUS FOR INSTALLING FASTENERS

The invention relates to apparatus for installing fasteners, and more particularly to such apparatus for installing successively a plurality of fasteners by repeated operation of a fastener installation tool which is loaded with a plurality of fasteners forming a finite supply of the fasteners to be installed thereby. The invention relates particularly, although not exclusively, to apparatus for the installation of fasteners of the type known as blind tubular rivets.

If the installation of fasteners is to continue after the fasteners which were initially loaded into the tool have been used, it is then necessary either to replace the tool with another, loaded, tool, or to re-load the original tool with a further supply of the fasteners to be installed thereby.

There is a practical limit to the number of fasteners which can be loaded into a tool, which limit depends upon the size of the tool and the size of the fasteners. The maximum size of tool is limited by the space available, in use of the tool, for access to a workpiece. For example, a tool which is used for the installation of blind tubular rivets of the type widely available in many countries under the Registered Trademarks BRIV and CHOBERT, can be loaded with a maximum of between 20 and 40 rivets, depending on the length of the rivet.

The tool must be reloaded when all the fasteners loaded in it have been installed. In the case of a tool being used, for example, on a production line where a certain number of fasteners must be installed in each workpiece, the tool must be reloaded when, having completed the installation of the required number of fasteners in one workpiece, the number of fasteners remaining in the tool for subsequent installation is less than the number required to be installed in the next workpiece. While the tool is being reloaded it cannot be used to install fasteners. If reloading requires that the tool be taken apart and re-assembled, the downtime required for reloading can be substantial, and may be as great as the time during which the tool can be used to install fasteners until it will need to be reloaded again. Thus, in the particular case of a repetition riveting tool intended for installing blind tubular rivets of the pull through type, in which a plurality of the tubular rivets have to be loaded on to an elongate mandrel having an enlarged head which is then pulled through each of the rivets successively in order to install the rivets in a workpiece, the time required to reload the tool can be as great as the time taken to install all the rivets the tool can hold.

The present invention is intended to reduce such down-time in the use of such tools.

Accordingly, the present invention provides, in one of its aspects, apparatus for installing fasteners, comprising a fastener installation tool for successively installing a plurality of fasteners by repeated operation of the tool, which tool has a fastener-carrying part which may be loaded with a plurality of fasteners forming a finite supply of the fasteners to be installed by the tool, which apparatus includes reception means for receiving the said fastener-carrying part from a used tool, and presentation means for presenting to the tool a different fastener-carrying part loaded with a supply of the fasteners.

The apparatus may include means for reloading such installation tool with a further supply of the fasteners. The apparatus may be arranged to exchange a loaded fastener-carrying part of an installation tool for a used fastener-carrying part of a tool, and may be arranged to re-load the used fastener-carrying part for subsequent exchange with another used fastener-carrying part which requires to be reloaded. Thus the installation tool may be enabled to operate nearly continuously using alternately reloaded fastener-carrying parts.

It may be that the apparatus includes reloading means for reloading with further fasteners a used fastener-carrying part of a tool. The reloading means may be operable to reload a fastener-carrying part of a tool received by the reception means, for subsequent presentation by the presentation means.

It may be that the presentation means is arranged to present successively a plurality of pre-loaded fastener-carrying parts, and the reception means is arranged to receive those fastener carrying parts successively after each has been used.

The reception means and its associated presentation means may be at separate stations.

Preferably the reception means and the presentation means are provided at the same station.

Preferably the apparatus includes; reception means for receiving a used fastener carrying part from a tool; presentation means for presenting to the tool a reloaded fastener-carrying part which has previously been received by the reception means and re-loaded with fasteners; and alternative presentation means for alternatively presenting to the tool a different preloaded fastener-carrying part.

The apparatus may include a plurality of alternative presentation means.

The apparatus may include second reception means for alternatively receiving a used fastener-carrying part.

The fastener installation apparatus may include control means for controlling the operation of the apparatus. The control means may be programmable. The control means may be programmed to actuate release of a used fastener-carrying part to the reception means when the number of fasteners remaining in the tool and available for subsequent installation by the tool falls below a predetermined minimum number.

The fastener installation apparatus may include means for moving the tool to a desired position. The control means may be operable to control the moving means to move the tool to the reception means and to cause release of the fastener-carrying part to the reception means when the number of the fasteners remaining in the tool and available for subsequent installation by the tool falls below a predetermined number.

When the fastener installation apparatus includes reloading means, the control means may also operate to control the reloading means to reload the used fastener-carrying part received by the reception means.

In a preferred embodiment of the invention, the fastener installation apparatus is arranged to install blind pull-through tubular rivets.

An embodiment of the invention will now be described, by way of example, with reference to the accompanying drawings, in which:

FIG. 5 is a side elevation of part of a rivet feeding and loading means forming part of the apparatus of FIG. 1;

FIG. 6 is a plan view of part of the rivet feeding and loading means;

Figure 1:
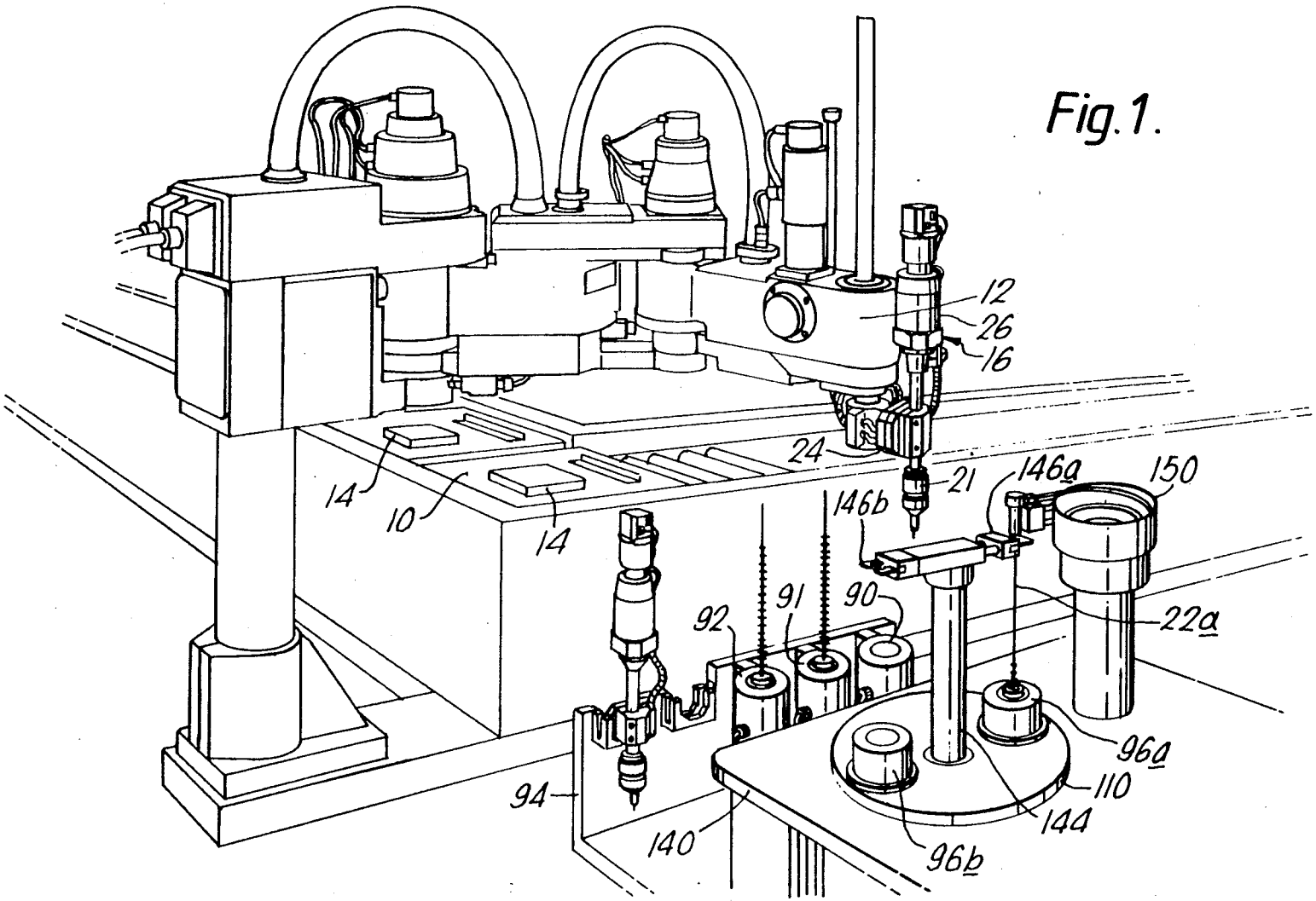
FIG. 1 is a simplified perspective view of an automated workstation incorporating fastener installation apparatus according to the invention, showing the principal parts of the apparatus, and their organization.

Referring first to FIG. 1, the automated workstation illustrated by way of example includes a workpiece conveyer 10 and a power-operated robot arm 12 with which is associated fastener installation apparatus embodying the invention. Workpieces 14 comprising members to be fastened together are conveyed by the conveyer to the workstation where the members are fastened together, and, after being fastened, are then conveyed away from the workstation.

At the workstation, the workpiece members are fastened together by installing one or more fasteners in registering apertures in the workpieces.

The installation of the fasteners is performed by a power-operated fastener installation tool 16 which is mounted on and carried by the robot arm 12 whereby the tool 16 can be moved and manipulated as necessary, and particularly so as to install fasteners in a succession of the workpieces 14 being conveyed through the workstation.

Figure 2:
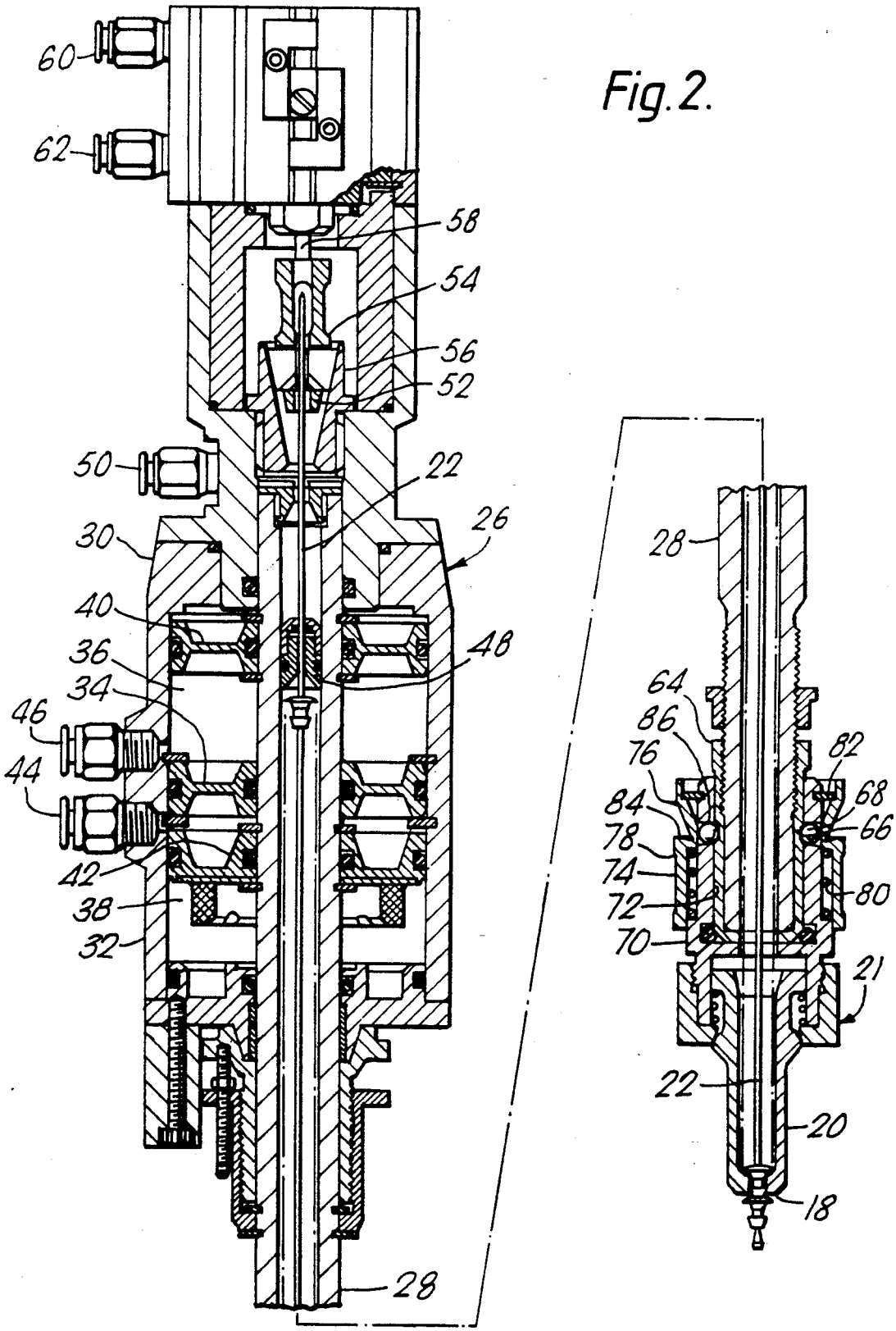
FIG. 2 is a sectional elevation of a fastener installation tool forming part of the apparatus of FIG. 1.

The installation tool 16 of this embodiment, shown in greater detail in FIG. 2, is a repetition riveting tool constructed for the installation of tubular blind rivets, and is of generally conventional construction, although it incorporates some features by which it is adapted to facilitate operation in a manner to be described.

The tool 16 comprises essentially an annular abutment 18, provided in this embodiment by a pair of cooperating separable nose jaws 20 forming part of a nose assembly 21, for supporting a rivet in a rivet setting operation, and an elongate headed mandrel 22 on to which a plurality of blind rivets forming a finite supply of the fasteners to be installed are loaded prior to use of the tool, together with means for advancing the rivets along the mandrel so as to pass the abutment one at a time and lie between the abutment and the head of the mandrel, and means for repeatedly reciprocating the mandrel lengthwise of its axis relative to the abutment so as to pull the head of the mandrel through the bores of each of a succession of the rivets supported in turn by the abutment, whereby the rivets can be deformed and set in a well known manner.

The tool 16 is designed for pneumatic operation, and is constructed as a unit which is detachably mounted on the robot arm 12 by means of a tool exchanger interface 24. The tool exchanger interface 24 has two complementary parts through which, in this embodiment, the tool is supplied with compressed air, and the necessary connections for electrical sensors are made, and permits another tool of the same type, or of another type if desired, to be substituted for the tool 16, in a well known manner.

Although the tool 16 will operate in, and can be manipulated into any attitude or orientation by the robot arm 12, in the following description it is assumed, for ease of understanding, that the tool is orientated so that the longitudinal axis of the mandrel 22 is vertical, with the head of the mandrel lowermost and the abutment 18 facing downwardly.

Referring more specifically to FIG. 2 of the drawings, the tool 16 comprises, in addition to the nose assembly 21 and the mandrel 22, a pneumatic actuator 26 which provides the means for producing the relative reciprocation between the abutment 18 and the mandrel 22, and the means for advancing rivets along the mandrel.

The actuator comprises primarily an elongate tubular barrel 28, and a housing 30 which contains other parts of the actuator. The housing 30 contains two principal functional units, namely mandrel gripping means for releasably gripping the upper end of the mandrel 22, and pulling means whereby the housing 30 can be caused to reciprocate relative to the barrel 28 in the direction lengthwise of the axis of the barrel.

The housing 30 is located generally around the upper end of the barrel 28, and the nose assembly 21 (which is not part of the actuator) is secured in readily detachable manner to the lower end of the barrel at a distance from the housing 30 which will influence the maximum number of fasteners with which the tool can be loaded, as will become apparent.

The barrel itself is secured to the tool exchanger interface 24 and is thereby held in fixed positional relationship to the robot arm 12 while the housing 30 is movable relative to the barrel and the robot arm. The barrel 28 is, in effect, the piston rod of a pneumatic piston assembly which is reciprocable in two in-line pneumatic cylinders defined within the housing 30.

The mandrel gripping means is contained in the upper part of the housing 30, and comprises a pair of tapered gripping jaws 52 carried by a generally tubular jaw carrier 54, and a jaw-closer 56 in the form of an annular bush seated within the housing so as to resist downward movement under pressure, and having a downwardly tapering bore. A double acting pneumatic jaw-closing piston 58 reciprocable in a cylinder (not shown) is operable by compressed air supplied through a clamping port 60 to drive the jaw carrier 54 downwardly, thus forcing the jaws 52 into the bore of the jaw closer 56 and causing the jaws to close and grip the upper end of a mandrel inserted between the jaws in the jaw carrier. Conversely, air supplied through a release port 62 raises the piston 58, allowing the jaws to relax their grip on the mandrel so that the mandrel can be withdrawn from the actuator.

The pulling means is contained in the lower part of the housing 30, below the gripping means. Thus, the lower part of the housing comprises a pulling section 32 having a bore of large diameter and of which the length is divided equally by annular wall 34 into coaxial upper and lower cylinders 36, 38 respectively. The annular wall 34 is keyed and sealed to the internal wall of the pulling section 32.

Disposed, and slidable, within the upper and lower cylinders 36, 38 are pistons 40, 42 respectively. The pistons 40, 42 are both keyed to the barrel at positions spaced from the upper end of the barrel 28, and divide their respective cylinders into upper and lower chambers.

Compressed air can be admitted to the two upper chambers through separate ports, of which only the port 44 is shown in FIG. 2, to move the pistons 40, 42 and the barrel relative to the housing 30 to produce a pulling stroke. Admission of air through a return port 46 into the lower chamber of the upper cylinder 30 effects a return stroke by producing relative movement of the pistons and barrel in the opposite direction. As the position of the barrel 28, and hence of the abutment 18, is fixed relative to the robot arm 12, the pulling and return strokes are manifest as actual movement of the housing 30 relative to the robot arm 12, and the abutment 18.

As previously indicated, in the normal condition of the tool, that is to say when the tool is ready to install a fastener, the upper end of the mandrel 22 is clamped between the gripping jaws, and the mandrel extends axially through the barrel 28 and through the nose assembly 21 which is attached to the lower end of the barrel. The enlarged head of the mandrel 22 is normally disposed below the abutment 18, as shown in FIG. 2 in which the tool is shown at the end the return stroke with the pistons 40, 42 at the upper ends of their respective cylinders. A plurality of tubular rivets to be installed are disposed on the mandrel, one of the rivets having descended through the nose assembly 21 to lie between the abutment 18 and the head of the mandrel, and the other rivets on the mandrel are positioned above the nose jaws 20.

Actuation of the tool, by supplying compressed air to the upper chambers of the cylinders 36, 38, causes the housing 30 to move upwardly, pulling the mandrel upwardly so that the mandrel head is drawn through the bore of the rivet which is below and supported by the abutment.

A cursor 48, in the form of an annular piston freely slidable within the bore of the barrel and surrounding the mandrel, is driven by compressed air entering the tool at a cursor drive port 50 and passing downwardly through the upper end of the barrel, to urge the rivets downwardly along the mandrel so that, as each lower most rivet is installed, another is forced past the nose jaws into the position previously occupied by the now installed rivet.

The nose assembly 21 is attached to the lower end of the barrel by engagement with a complementary sleeve 64 which surrounds the lower end portion of the barrel 28. The sleeve 64 is threadedly engaged with the barrel on which it can be more or less permanently retained. The sleeve has four recesses 66 of part-spherical shape disposed equi-angularly around its circumference and into which six steel balls 68 carried by the nose assembly can engage so as to retain the nose assembly on the sleeved lower end of the barrel 28.

Thus, the nose assembly 21 comprises a tubular body 70 having an axial bore 72 into which the sleeved lower end of the barrel can be inserted, and six radial bores in which the six balls 68 are housed. A shroud 74 surrounds the body 70 and is movable to cause either the release or the locking engagement of the nose assembly relative to the sleeved end of the barrel. The shroud 74 has a flared upper part 76 and a cylindrical lower part 78. The lower part 78 surrounds the body with some clearance, forming an annular housing for a helical compression spring 80. The spring 80 abuts a flange of the body at its lower end, and its upper end engages a shoulder of the shroud, so that the spring is compressed and resiliently urges the shroud upwardly into engagement with a stop 82.

The upper part 76 of the shroud flares, both externally and internally, in the direction away from the lower part so that the lower part 78 presents an external annular shoulder 84 at the point where it meets the smaller diameter end of the upper part 76. Internally, the flared upper part reduces towards the lower part to form a collar region 86 which is a close sliding fit around the body 70. In the spring biased upward position of the shroud, the collar region 86 thereof urges the steel balls 68 inwardly so that they partly enter the recesses 66 of the sleeve 64 and thus secure the nose assembly to the sleeved end of the barrel. However, on urging the shroud downwardly against the spring, the collar region is moved out of register with the balls 68, and the internally flared region of the upper part comes into register with the balls, allowing them to move radially outwardly into the conical space defined between the flared part of the shroud and the body 70 at least sufficiently for the balls to disengage from the recesses 66 in the sleeve 64. Thus, on urging the shroud downwardly, the nose assembly is unlocked and can be separated from the sleeved barrel.

The tool 12 just described can be loaded with up to 40 fasteners of a given size, and when by use of the tool they have all been installed or there remains an insufficient number to complete another task, it is necessary to reload the tool with further fasteners. The operation of the tool and the number of fasteners installed by the tool is monitored by suitably programmed control means, of which some mention will be made subsequently. The control means also initiates and controls a programme of events whereby a tool having a depleted supply of fasteners is reloaded.

Reloading is effected by removing the nose assembly 21 together with the mandrel 22 and any remaining fasteners from the actuator 26, and then either reloading the mandrel and replacing it together with the same nose assembly into the tool, or substituting another loaded mandrel, together with another nose assembly, for that removed. The latter course is more expedient since it avoids delaying use of the tool while further fasteners are loaded on the mandrel, and hence reduces the necessary downtime.

It is to be understood that, in order to reload a mandrel 22 it is necessary to release it from the gripping jaws 52 and remove it from the actuator so that further fasteners can be threaded on to the mandrel at the end remote from the mandrel head. It is not necessary, however, to separate the mandrel from the nose assembly, for reloading, because the column of rivets with which the mandrel is loaded must be above the nose assembly, and is advanced downwardly as required by the cursor 48.

The mandrel, of course, constitutes the fastener-carrying part previously referred to.

Thus, the mandrel and the nose assembly of a tool can remain more or less permanently associated through several cycles of use and reloading. In view of this, the more general term "nose equipment" is used hereinafter to refer to the combination of a mandrel and its associated nose assembly.

Means will now be described whereby, under the control of the control means, the tool can be reloaded by removal of the nose assembly and mandrel from the tool and substitution of another nose assembly and a loaded mandrel, and whereby, furthermore, the mandrel so removed can be reloaded so as to be ready together with the removed nose assembly, to replace the previously substituted mandrel and nose assembly when the tool next requires reloading.

Thus, by using a single actuator together with two sets of nose equipment which are each used alternately in rotation while the other is being reloaded, the downtime required for the tool is only that taken to substitute one set of nose equipment for another.

Referring again to FIG. 1, the automated workstation illustrated has two independent systems for enabling the reloading of a tool, one of which is relatively unsophisticated, and regarded as an alternative to a preferred system, and will be described first and briefly, and the other of which is more sophisticated and preferred and will be described subsequently. Either of the systems can be provided or omitted, or as in this embodiment, both can be provided for use as alternatives.

The first system is represented by the provision of nests, of which, in this embodiment, there are three, indicated by the references 90, 91, 92. The nests 90, 91, 92 are mounted on a rack 94 so as to be within reach of the robot arm 12. Each nest provides a receptacle for receiving and holding a set of nose equipment, and includes means for releasing the nose assembly from an actuator so that, after also releasing the mandrel from the gripping jaws, the actuator can be moved away leaving the nose equipment in the nest.

Of the three nests 90, 91, 92, at least one is normally left vacant and ready to receive a set of nose equipment, and at least one other normally contains another set of nose equipment having a loaded mandrel, which may have been loaded in any suitable manner, ready for presentation to a actuator from which the nose equipment has been removed.

In addition to the nests, the rack may also hold a spare complete tool, loaded with fasteners, and ready to be substituted for that attached to the robot arm 12 through the tool exchange interface 24 whenever the need arises.

Figure 3:
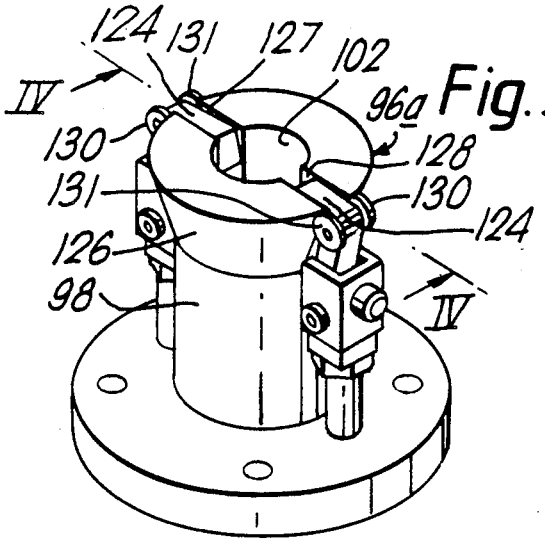
FIG. 3 is a scrap perspective view of a nest for the reception and/or presentation of part of an installation tool.
Figure 4:
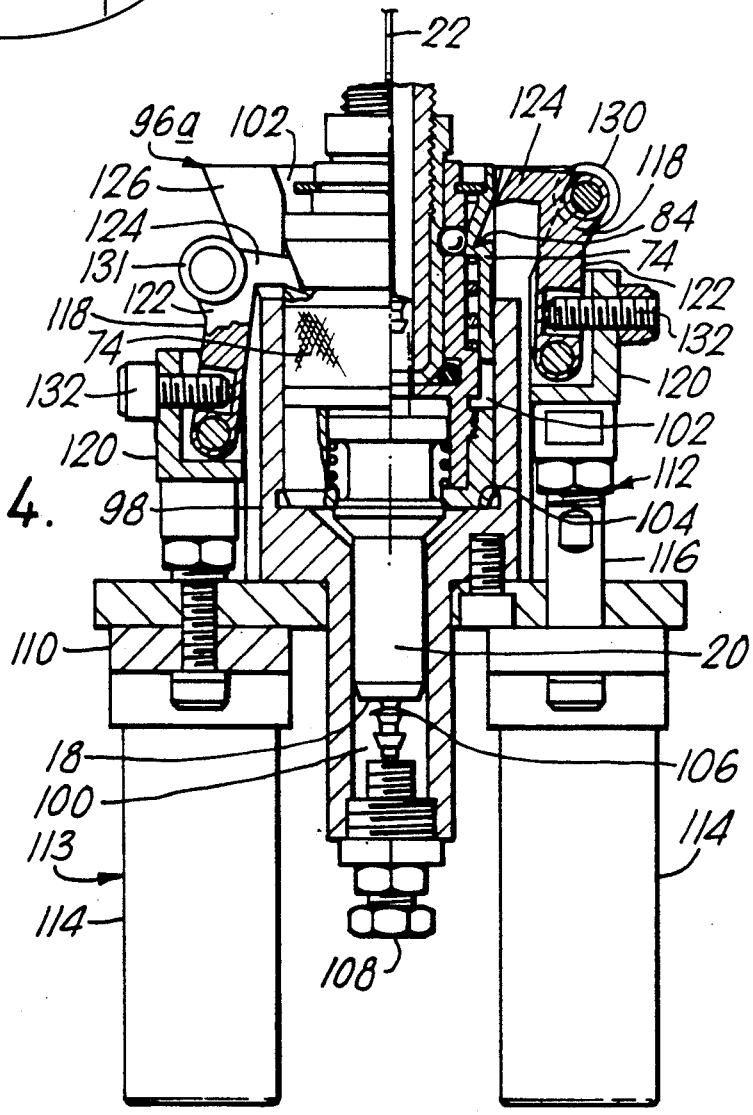
FIG. 4 is a sectional elevation on the line IV—IV of FIG. 3.

A nest **96*a*, identical with the nest 90, is shown in FIG. 3 in perspective and in somewhat greater detail than in FIG. 1, and is shown in FIG. 4, in cross section on the lines IV—IV of FIGS. 1 and 3** together with a nose assembly and a partly loaded mandrel disposed in the nest.

Referring to FIGS. 3 and 4, the nest **96*a* comprises a hollow receptacle 98, defining a cavity, the shape of which is generally complementary to that of the nose assembly 21 of the tool 12, which is to say that the cavity has a lower region 100 which fits closely around the nose jaws 20, and an upper region 102, of larger diameter than the lower region, in which the upper part of the nose assembly, including the shroud 74, can be accommodated with slight radial clearance. Between the upper and lower regions of the cavity the receptacle defines an annular shoulder 104 on which the body 70 of the nose assembly can rest while the nose jaws 20 extend downwardly into the lower region 100 of the cavity. A tubular blind rivet 106 is located on the mandrel 22 between the abutment 18 and the head of the mandrel, and the lower end of the cavity is closed by a stop screw 108 which is threadedly engaged with the receptacle 98. The stop screw 108 is adjustable in height within the lower region 100 of the cavity so as to support the mandrel 22 while allowing minimal clearance for the rivet 106 between the abutment 18** and the mandrel head.

The receptacle 98 is mounted on a table 110 through which the lower part of the receptacle extends. The table 110 also supports a pair of pneumatic retractors 112, 113 which form part of the nest **96*a* and are disposed on diametrically opposite sides of the receptacle. Each retractor comprises a pneumatic retractor cylinder 114 disposed below the table and having a retractor piston 116 vertically reciprocable therein. The piston 116 extends upwardly through the table, and supports a pawl 118 which is pivotally mounted in a trunnion 120 which in turn is adjustably mounted on the upper end of the piston 116. The pawl 118 comprises a substantially vertical limb 122 the lower end of which pivots in the trunnion 120, and a claw 124, the claws of the two retractors extending towards each other and radially inwardly of the receptacle. The upper part of the receptacle is externally flared, forming an external cam surface 126 for the pawls, and has two diametrically opposed radial slots 127, 128, in which the claws 124 are movable in directions both vertically and radially of the receptacle. Each of the pawls has a pair of rollers 130, 131 journalled for rotation about a horizontal axis passing through the pawl at the angle between the claw and the vertical limb, the rollers being arranged to bear and roll on the flared external cam surface 126 at the upper end of the receptacle on each side of the slot in which the claw is disposed. Each pawl is biased, by a spring-loaded plunger 133** mounted in the trunnion, to pivot so that the claw tends to move radially inwardly of the receptacle, but is limited in the extent of its inward movement by the engagement of the rollers against the cam surface of the receptacle.

The retractor cylinders 114 are supplied with compressed air under the control of the control means.

The operation of the nests is as follows.

When the control means senses that the tool 16 requires to be reloaded, the robot arm carries the tool to a position directly above the nest 90 and then lowers the tool so that the nose assembly 21 enters the cavity of the receptacle 98 and the lower end of the body 70 rests on the shoulder 104. This is the condition shown in the right-hand half of FIG. 4.

The control means then operates to admit air through the release port 62 of the actuator, causing the piston 58 to retract so that the gripping jaws relax their grip on the tail end of the mandrel, and at the same time operates to admit air to the upper chambers of the two retractor cylinders 114 of the nest 90, causing the retractor pistons 116 to be pulled downwardly relative to the receptacle 98. Descent of the pistons 116 causes the spring biassed pawls 118 to descend also, and, as the rollers 130, 131 are able to follow the cam surface 126 of the receptacle, the spring biassed pawls pivot so that the claws move radially inwardly and engage the annular shoulder 84 on the shrud of the nose assembly. Continued descent of the pistons 116 causes the pawls to pull the shroud downwardly, thus releasing the nose assembly from engagement with the barrel of the actuator. With the mandrel and nose assembly (that is to say, the nose equipment) thus released from the actuator and held in the nest, the actuator of the tool is then raised vertically by the robot arm until it is clear of the upper end of the mandrel, leaving the nose equipment in the nest. The robot arm then traverses to position the actuator above another nest which holds a set of nose equipment having a suitable load of fasteners, such as the nest 91, and then lowers the actuator so that the sleeved end of the barrel decends around the loaded mandrel and enters into the nose assembly in the nest 91. The retractor pistons of the nest 91 are then urged upwardly by air admitted to the lower chamber of the retractor cylinders, raising the pawls and thus allowing the shroud to rise under the influence of the helical spring 80. As the shroud rises, the steel balls are urged radially inwardly into engagement with the sleeved end of the barrel, thus locking the nose assembly to the actuator. Simultaneously with the rise of the retractor pistons, air is admitted through the clamping port 60 to urge the piston 58 and the jaw carrier 54 downwardly, thus clamping the loaded mandrel between the gripping jaws 52.

As the pawls rise, their rollers follow the flaring cam surface of the receptacle and the pawls are thereby caused to pivot, moving the claws radially outwardly and thus disengaging the claws from the nose assembly.

Thus the nose assembly and the actuator are reassembled and released from the nest 92, and the tool is ready to be moved away from the nest by the robot arm and to resume installing fasteners.

The first alternative system just described does not include any provision for reloading a mandrel with further fasteners. However, the nest **96*a*** is part of the preferred second system, previously referred to, which includes means for reloading a mandrel.

The second system is illustrated schematically in FIGS. 7 to 13 which also illustrate successive stages in the operation of the system.

Figure 7:
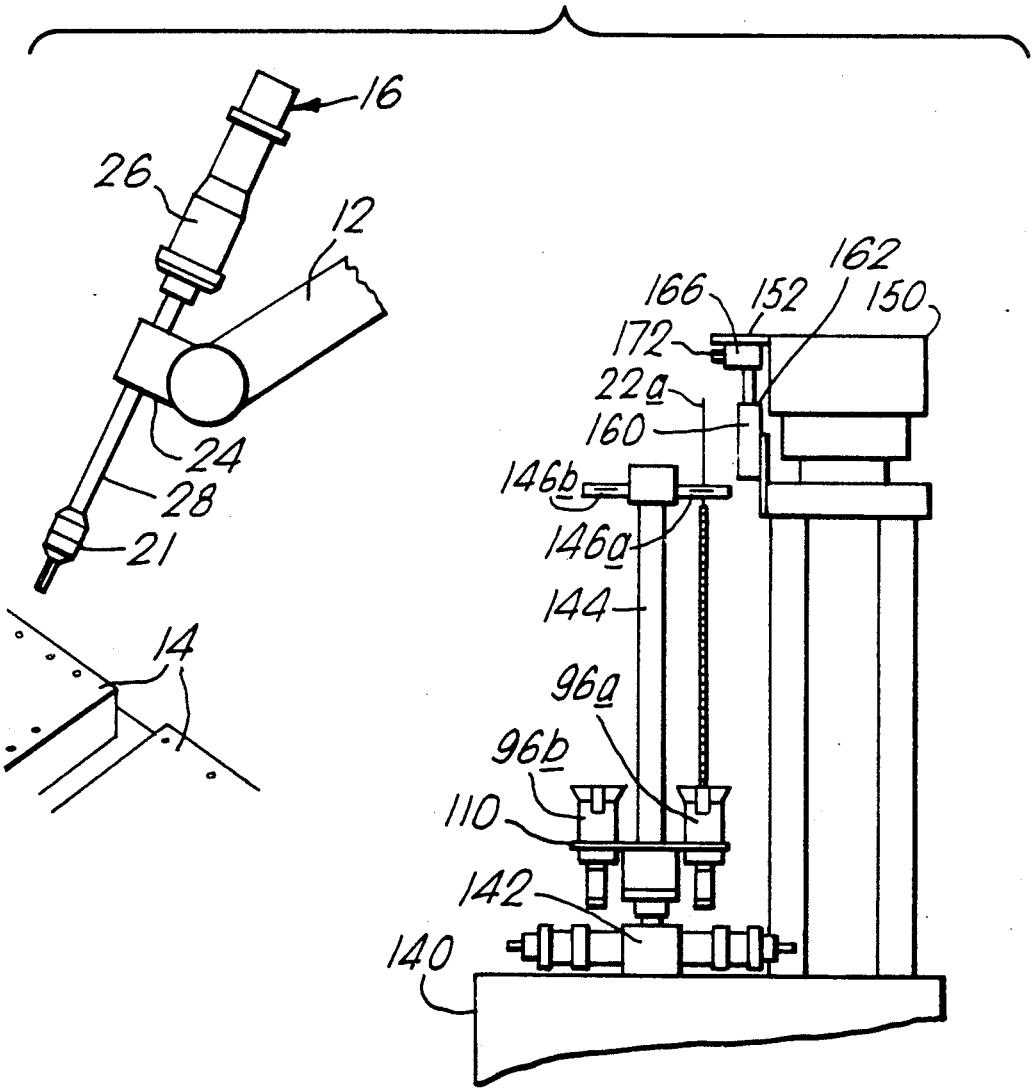
FIGS. 7 to 13 are schematic elevational views showing the positions of principal parts of the apparatus in successive stages of operation.

Thus referring to FIG. 7, the table 110 previously referred to is an indexing table mounted for indexing rotation through 180° about a vertical axis on a suitable support 140 within reach of the robot arm 12.

A pneumatically operated rack and pinion indexing mechanism 142, of conventional and commercially available type, is mounted on the support 140 and supports and produces the indexing movement of the table 110 in response to the supply of pressurised air under the control of the control means in a well known manner.

The table 110 supports the nest **96*a* and a second nest 96*b* identical to the nest 96*a***.

The nests **96*a* and 96*b*** are disposed equidistant from and on diametrically opposite sides of the rotational axis of the indexing table so that, on indexing the table through 180°, each nest moves into the precise position in space previously occupied by the other.

The position occupied by the nest **96*b*, as seen in FIG. 1, is a station for the reception and the presentation of nose equipment from and to an actuator 26 carried by the robot arm 12, and the position occupied by the nest 96*a* as seen in FIG. 1, is a reloading station at which a mandrel of the nose equipment held in the nest 96*a* can be loaded or reloaded with fasteners. Indexing the table through 180° moves both the nests 96*a* and 96*b*** from their respective stations to the other of the stations.

The mandrels of the riveting tools are made of steel wire and are easily flexible. It is therefore necessary to provide means for accurately locating in transverse position the upper ends of mandrels of nose equipment held in the nests **96*a* and 96*b* in order to facilitate both the loading or reloading of such mandrels with further rivets, and also to facilitate the reassembly of an actuator 26 carried by the robot arm 12** with nose equipment held in one of the nests.

Accordingly, the indexing table 110 carries means for locating the upper end portion of a mandrel held in each of the nests **96*a* and 96*b***.

The locating means comprises a column 144 mounted vertically at the rotational axis of the table, and two pneumatically operable mandrel locators **146*a* and 146*b* supported by the column at a height above the nests 96*a* and 96*b*** respectively, which will be near to, but not at, the upper ends of mandrels of nose equipment held by the nests.

Each mandrel locator comprises a double acting pneumatic actuator and a pair of locating jaws which can be operated by the locator actuator so as to move between a mandrel-holding position in which the jaws are positioned vertically above the respective nest and are closed about a mandrel of nose equipment held by the nest, and a position in which the jaws are opened, and the mandrel released, and are retracted away from the position vertically above the nest.

Thus, in the mandrel-holding position, the locating jaws engage the mandrel at a position spaced a short distance from its upper end and locate it precisely so that either a tubular rivet or an actuator of a riveting tool can be threaded on to the upper end of the mandrel. More particularly, the locating jaws are shaped so that the upper end of a mandrel which is flexing, or slightly bent out of line, may be gathered into a precisely fixed transverse position relative to the nest holding the mandrel.

Also mounted on the support 140, in a position adjacent to the indexing table 110, is means for loading tubular rivets on to a mandrel disposed in one of the nests, which, in the phase of operation shown in FIGS. 1 and 7, is the nest **96*a***.

The loading means of this embodiment comprises a bowl feeder 150 of conventional construction and arranged to orientate and feed rivets along a flight 152.

The tubular rivets illustrated in the drawings are of the type sold under the Registered Trade Mark "BRIV", and comprise a shank of generally cylindrical and elongate shape, and a radially enlarged head at one end of the shank with a bore passing axially through the shank and head. The orientated rivets pass along the flight with their heads uppermost and supported by the flight and with their shanks depending below the flight through a slot in the flight.

The end of the flight remote from the bowl feeder is provided with a spring loaded gate 154 whereby the rivets are prevented from freely leaving the end of the flight, as shown in FIG. 6. Rivets arriving at the gate 154 are periodically removed from the flight and are transferred by a rivet transfer device 160 to a mandrel disposed in that one of the nests **96*a* and 96*b*** which, in a given phase of operation of the apparatus, is at the loading station.

The rivet transfer device 160 is shown more particularly in FIG. 5, and comprises a pneumatic jack 162 having a cylinder housing mounted on the support 140, and three vertically reciprocable pistons 164. Mounted on the upper ends of the pistons 164 is a transfer gripper 166.

The transfer gripper 166 comprises a pneumatic cylinder housing secured to the upper ends of the pistons 164, and three horizontally reciprocable pistons 168 to which is attached a rivet carrier 170. The rivet carrier 170 includes a pair of horizontally opposed power-operated rivet gripping jaws 172 arranged to engage and grip a rivet held at the spring-loaded gate 154 of the flight, and, on suitable movement of the horizontally reciprocable pistons 168, to pluck the rivet from the flight, through the gate, and move the rivet to a position precisely above the upper end of a mandrel disposed in the nest at the loading station. On causing the vertical pistons 164 to descend, the jaws 172 holding the rivet are lowered so that the rivet is threaded on to the upper end of the mandrel. The jaws 172 then release the rivet which is able to descend by gravity, past the mandrel locators which open momentarily to allow the rivet to pass, and join any rivets previously disposed on the mandrel, forming a column of rivets.

As soon as the jaws 172 have released the rivet on the mandrel, the horizontally reciprocable pistons 168 are retracted and the transfer gripper is raised by the vertically reciprocable pistons 164 to the position in which the gripper is ready to remove the next rivet waiting at the gate 154 of the flight.

The sequence of events just described is performed rapidly under the control of the control means, and enables a mandrel disposed in the nest at the loading station to be loaded with a plurality of rivets, fed one at a time.

Some successive phases of the operation of the rivet transfer device are shown in FIGS. 7 to 13.

Referring now specifically to FIGS. 7 to 13 of the drawings, and initially to FIG. 7, the operation of the apparatus to reload a used tool, using the preferred reloading system, will now be described.

FIG. 7 shows workpieces 14 on the conveyor 10, the robot arm 12 which supports an installation tool 16 which has installed part of its load of tubular rivets in a workpiece on the conveyor and requires to be reloaded with rivets, and the reloading means adjacent to the conveyor.

The nest **96*b* is positioned at the reception and presentation station by the indexing table 110, and is vacant, and the nest 96*a* is positioned at the reloading station and holds a set of nose equipment, including a mandrel 22*a*, which is additional to the set of nose equipment forming part of the tool 16** held by the robot arm.

As shown in FIG. 7, the mandrel **22*a* has been fully loaded with a column of the tubular rivets which extends up the mandrel to the mandrel locator 146*a*, and is ready to replace the mandrel of the tool 16** in which the load of rivets is depleted.

Figure 8:
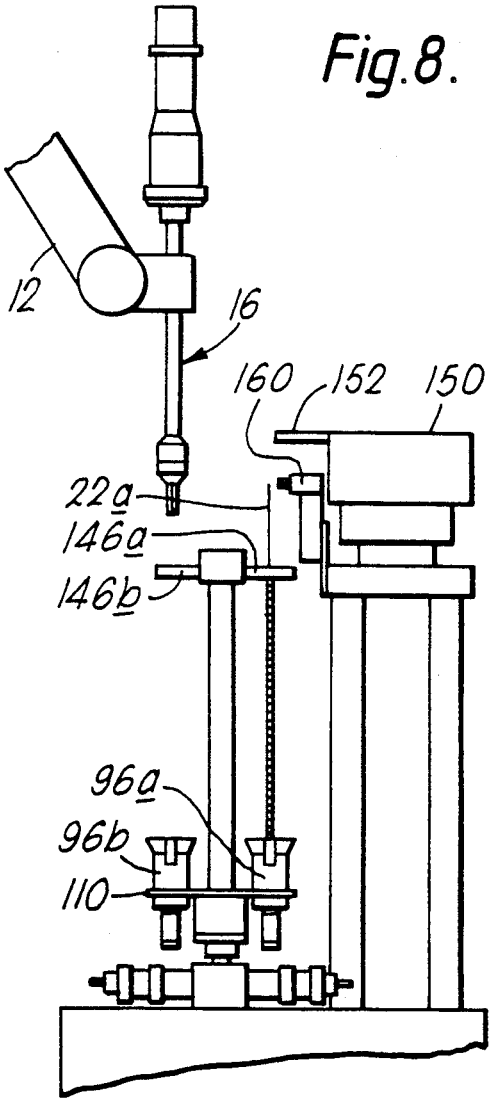

The robot arm then moves the tool 12 into position vertically spaced above the vacant nest **96*b* as shown in FIG. 8: the locating jaws of the mandrel locator 146*b*** are open.

Figure 9:
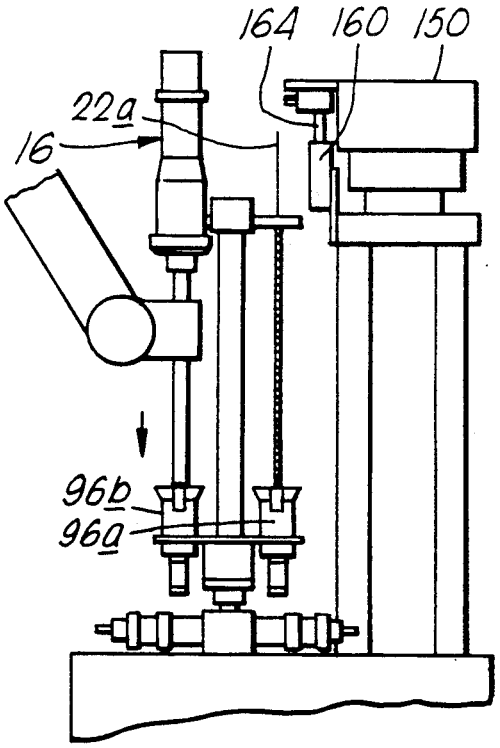

The robot arm then lowers the tool between the open locating jaws until the nose equipment of the tool enters the receptacle of the nest **96*b* as shown in FIG. 9. The mandrel of the tool 12 is then released from the grip of the gripping jaws 52 by operation of the jaw closing piston 58, and the pneumatic retractors of the nest 96*b* are operated to pull their pawls downwardly, thus releasing the nose equipment from the actuator of the tool 16**.

Figure 10:
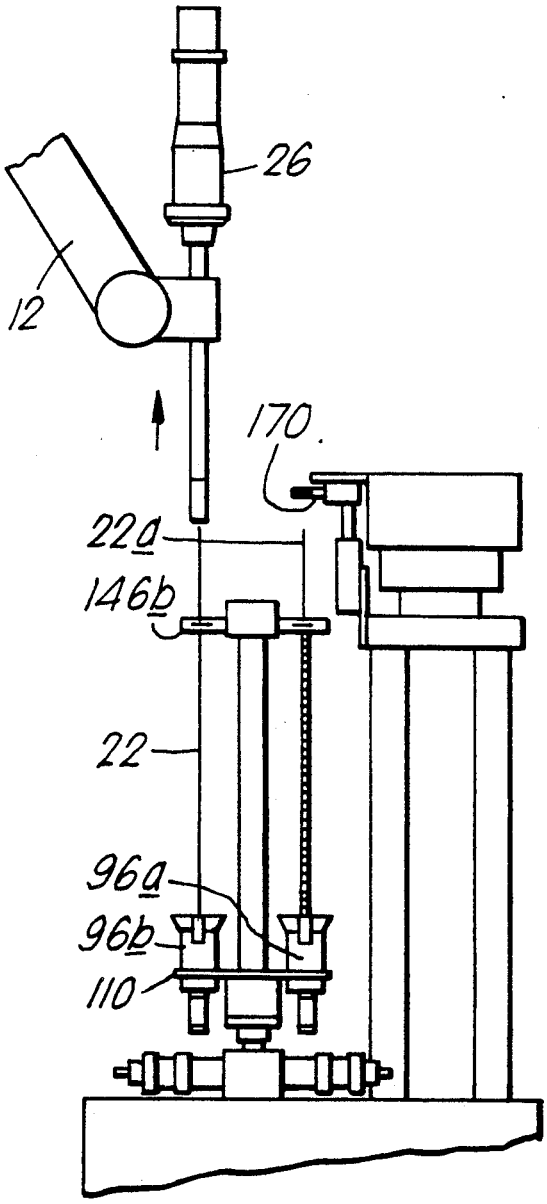

The robot arm then rises, carrying the actuator 26 of the tool 16 upwardly, and leaving the nose equipment of the tool in the nest **96*b* as shown in FIG. 10. The actuator 26 rises clear of the mandrel 22**, and the locating jaws then close around the mandrel.

Figure 11:
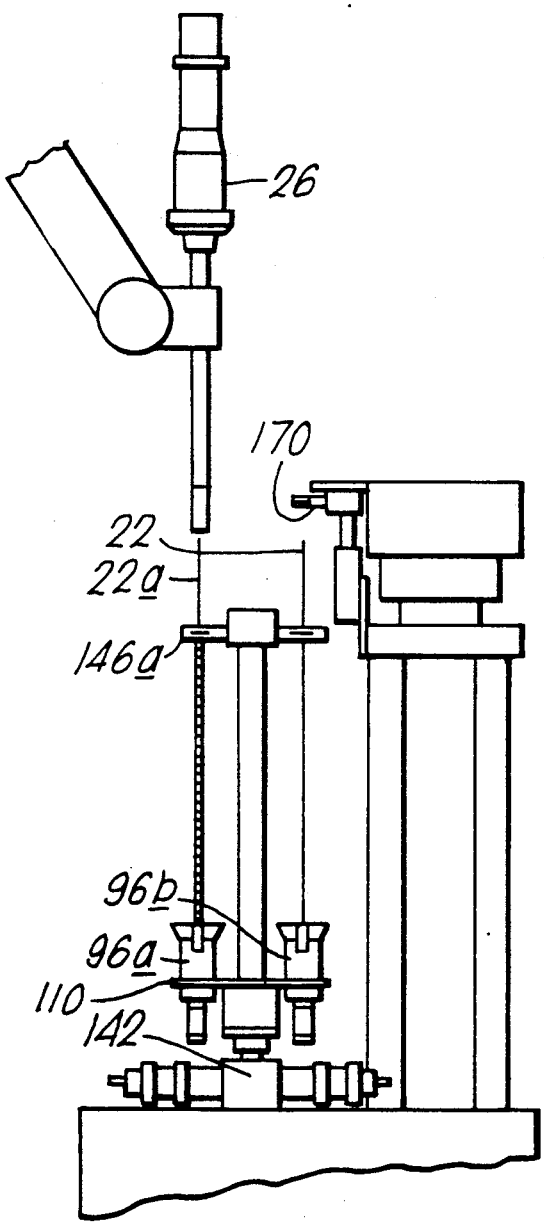

The indexing table 110 then indexes through 180°, transposing the nests **96*a* and 96*b* so that the nose equipment just received from the tool 12 is moved to the loading station, and the nose equipment with the ready loaded mandrel 22*a* is moved to the reception and presentation station below the actuator 26, as shown in FIG. 11**.

The robot arm then lowers the actuator 26 so that the mandrel **22*a* passes into the barrel, threading its way through the cursor 48, and eventually into position between the gripping jaws 52. As the actuator descends and the lower end of the barrel approaches the mandrel locator 146*a***, the locating jaws open to allow the barrel to pass.

When the sleeved lower end of the barrel has fully entered the nose assembly 21 in the receptacle of nest **96*a*, the jaw closing piston 58 is operated to close the gripping jaws 52 of the actuator on the mandrel 22*a*, and the actuator pistons of the nest 96*a* are operated to raise the pawls so that, guided by the cam surface of the receptacle, the pawls allow the shroud to rise and urge the balls of the nose assembly into engagement with the sleeved end of the barrel, thus locking the loaded nose equipment to the actuator 26**, and releasing their hold on the nose assembly.

Figure 12:
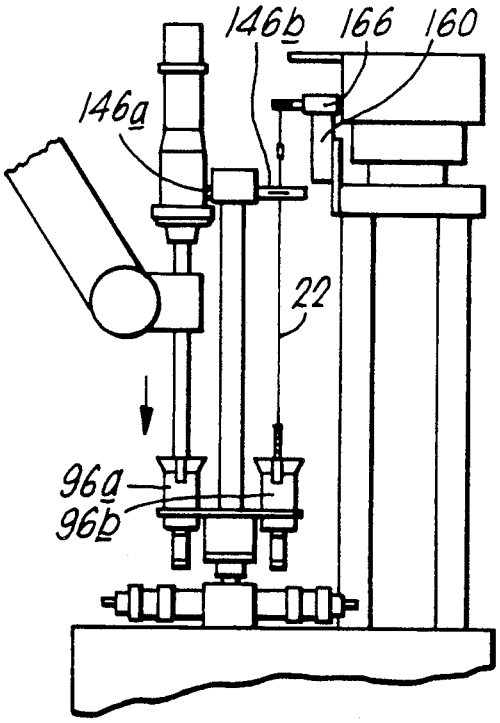
Figure 13:
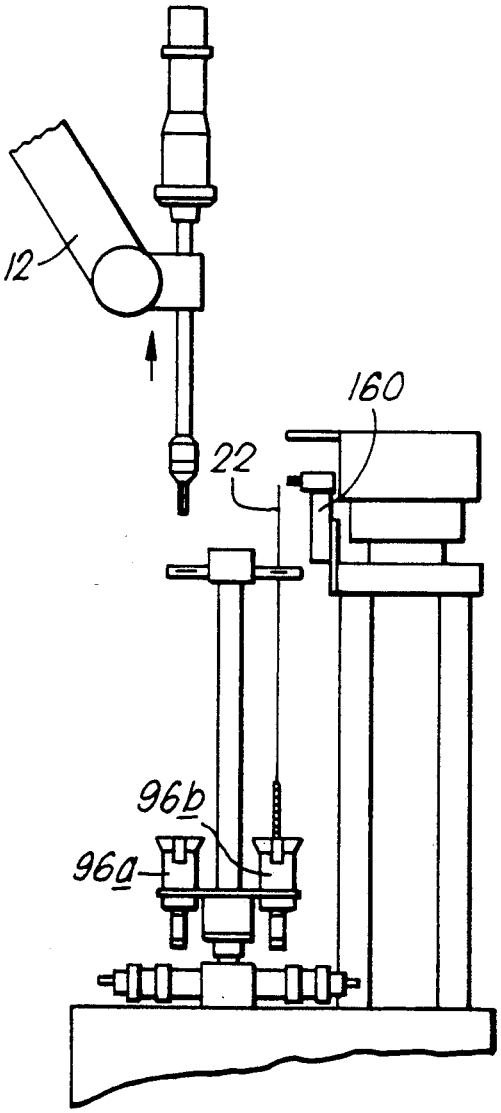

Meanwhile, the nose equipment earlier removed from the tool 12, and now in the nest **96*b* at the reloading station is being reloaded with further rivets by the reloading means, as previously explained. This stage is shown in FIG. 12**.

The tool 12, now reassembled using the loaded nose equipment including the mandrel **22*a***, is free to be moved away from the reception and presentation station by the robot arm, and to resume installing rivets in workpieces on the conveyor.

Reloading of the nose equipment in the nest **96*b* continues until the mandrel 22 thereof is fully loaded, and then stops, and the thus reloaded nose equipment remains at the reloading station until required to replace the nose equipment of the tool 12** when the tool next needs to be reloaded.

Reference has been made to the control means by which the operation of the apparatus is controlled, and this will now be described.

The control means is of a generally conventional type, and uses conventional parts in a manner which is generally well understood in the control of apparatus for performing operations. The following description is, therefore, only concerned with the principal parts and their organization to effect the necessary control over the operation of the apparatus for installing fasteners.

It will be appreciated that a principal feature of the automated workstation shown in FIG. 1 is the robot arm 12, and that the robot arm is provided with a general controller which is housed in the mounting for the robot arm. The general controller is programmable to control not only the operation of the robot arm 12, but also the operation of any other ancillary apparatus associated with the robot arm at the workstation. The general controller converses with individual controllers of ancillary apparatus at the workstation, so that the operation of all parts of the workstation are coordinated.

The operation of the installation tool 12 and the reloading means, and the logical co-ordination of their operations are under the control of a programmable logic controller.

The logic controller receives data input from sensors of various types which are disposed at appropriate locations to sense events occurring in the apparatus; it converses with the general controller, and it gives outputs which directly or indirectly actuate the performance of the various operations which parts of the apparatus have to perform.

Thus, a number of sensors are disposed at appropriate positions to monitor various conditions and the operation of the various actuators of the apparatus. The sensors include optical sensors, inductive proximity sensors, and magnetic reed switches, and are deployed to monitor the operation of the riveting tool 12 and the reloading means, and pass resultant data to the programmable logic controller. Particular mention is made here of the use of sensors to monitor the presence or absence of rivets at the gate 154 of the flight, the opening and closing of the rivet gripping jaws and the presence or absence of a rivet between them, the end points of reciprocation of the transfer gripper in both vertical and horizontal directions, the opening and closing of the mandrel locators 146*a* and 146*b*, the presence or absence of nose equipment in the nests, and the reciprocatory movements of the retractor pistons 116, the indexing movements of the indexing table 110, and to sense when a column of rivets on a mandrel being reloaded at the loading station reaches a predetermined height. Sensors are also employed to monitor the movements of the jaw-closing piston 58, and the reciprocatory movements of the barrel 28 relative to the housing 30 of the actuator.

Outputs from the logic controller operate solenoid-operated valves which control the flow of pressurized air in the pneumatic circuits from a source of compressed air to the actuator 26 and the pneumatic cylinders of the reloading means.

The programmable logic controller includes means for keeping count of the numbers of rivets in the system and available for installation. Thus, the number of rivets loaded on to mandrels at the reloading station and subsequently loaded into the installation tool 12 is known from the size of the rivets and the predetermined height of the column of rivets loaded on to the mandrel, and the number of rivets installed by the tool is counted by the logic controller. A comparator in the logic controller is then able to calculate the number of rivets remaining in the tool and available for installation in workpieces. When the number of rivets in the tool falls below that predetermined number of rivets needed to perform a complete task, the control means allows completion of the task in hand, and then initiates reloading of the tool.

The invention is not restricted to the details of the foregoing example.

We claim:

1. Apparatus for installing fasteners, comprising:

a fastener installation tool for successively installing a plurality of fasteners by repeated operation of the tool, said tool including a fastener-carrying part which is detachable from said tool, and which may be loaded with a plurality of fasteners forming a finite supply of the fasteners;

reception means for receiving said detachable fastener-carrying part and holding said part when said part is detached from said tool;

and presentation means for presenting for attachment to the tool another fastener-carrying part loaded with a supply of the fasteners.

2. Apparatus as claimed in claim 1, wherein the reception means and the presentation means are operable alternately as presentation means and reception means, respectively.

3. Apparatus as claimed in either of claims 1 or 2, wherein the presentation means is arranged to present successively to the tool a plurality of the fastener-carrying parts loaded with the fasteners, and the reception means is arranged to receive successively from the tool a plurality of the fasteners-carrying parts.

4. Apparatus as claimed in claim 3, wherein the reception means comprises at least one nest for the reception of a used fastener-carrying part, and the presentation means comprises at least one nest for the presentation of one or more loaded fastener-carrying parts.

5. Apparatus as claimed in claim 4, wherein the presentation means comprises a plurality of nests each containing a pre-loaded fastener-carrying part, for successive presentation of the parts to the tool.

6. Apparatus as claimed in any of claims 1 or 2, wherein the reception means and the presentation means each comprise a nest, the nests being movable alternately to and from a station for the reception and presentation of fastener-carrying parts.

7. Apparatus as in claimed in claim 6, wherein the nests are movable between the station for the reception and presentation of fastener carrying parts, and a reloading station at which fastener-carrying parts received at the reception and presentation station and moved to the reloading station may be loaded or reloaded with fasteners.

8. Apparatus as claimed in claim 7, further including means for loading or reloading with fastener-carrying parts disposed at the reloading station.

9. Apparatus as claimed in claim 3, wherein the reception means and the presentation means each comprise a nest, the nests being movable alternately to and from a station for the reception and presentation of fastener-carrying parts.

10. Apparatus as claimed in claim 4, wherein the reception means and the presentation means each comprise a nest, the nests being movable alternately to and from a station for the reception and presentation of fastener-carrying parts.

11. Apparatus as claimed in claim 9, wherein the nests are movable between the station for the reception and presentation of fastener carrying parts, and a reloading station at which fastener-carrying parts received at the reception and presentation station and moved to the reloading station may be loaded or reloaded with fasteners.

12. Apparatus as claimed in claim 10, wherein the nests are movable between the station for the reception and presentation of fastener carrying parts, and a reloading station at which fastener-carrying parts received at the reception and presentation station and moved to the reloading station may be loaded or reloaded with fasteners.

13. Apparatus as claimed in claim 11, further including means for loading or reloading with fasteners fastener-carrying parts disposed at the reloading station.

14. Apparatus as claimed in claim 12, further including means for loading or reloading with fasteners fastener-carrying parts disposed at the reloading station.

15. Apparatus as claimed in claim 1, wherein said fastener-carrying part includes a mandrel and a nose assembly.

16. Apparatus as claimed in claim 1, wherein said reception means includes means for effecting release of said detachable fastener-carrying part from said tool.

17. Apparatus as claimed in claim 1, wherein said presentation means includes means for effecting attachment of said other fastener-carrying part to said tool.

18. Apparatus as claimed in claim 1, wherein the fastener-carrying part is an elongate mandrel onto which a plurality of tubular fasteners may be loaded, the mandrel having an enlarged head which can be pulled through each of the tubular fasteners successively in order to set each fastener.

* * * * *